United States Patent [19]

Terauchi

[11] Patent Number: 4,527,963

[45] Date of Patent: Jul. 9, 1985

[54] SCROLL TYPE COMPRESSOR WITH LUBRICATING SYSTEM

[75] Inventor: Kiyoshi Terauchi, Gunma, Japan

[73] Assignee: Sanden Corporation, Japan

[21] Appl. No.: 537,442

[22] Filed: Sep. 30, 1983

[30] Foreign Application Priority Data

Sep. 30, 1982 [JP] Japan ..... 57-148267

[51] Int. Cl.[3] ..... F04C 18/04; F04C 29/02

[52] U.S. Cl. ..... 418/55; 418/100; 418/102; 418/DIG. 1

[58] Field of Search ..... 418/55, 59, 100, 102, 418/DIG. 1

[56] References Cited

U.S. PATENT DOCUMENTS

| | | | |
|---|---|---|---|
| 801,182 | 10/1905 | Creux | 418/55 |
| 3,924,977 | 12/1975 | McCullough | 418/55 |
| 4,209,287 | 6/1980 | Takada | 418/93 |
| 4,259,043 | 3/1981 | Hidden et al. | 418/55 |
| 4,304,535 | 12/1981 | Terauchi | 418/55 |
| 4,314,796 | 2/1982 | Terauchi | 417/294 |
| 4,332,535 | 6/1982 | Terauchi et al. | 418/55 |
| 4,340,339 | 7/1982 | Hiraga et al. | 418/55 |
| 4,343,599 | 8/1982 | Kousokabe | 418/55 |
| 4,345,886 | 8/1982 | Nakayama et al. | 418/100 |
| 4,396,364 | 8/1983 | Tojo et al. | 418/55 |
| 4,439,118 | 3/1984 | Iimori | 418/55 |

FOREIGN PATENT DOCUMENTS

| | | | |
|---|---|---|---|
| 55-60685 | 5/1980 | Japan . | |
| 57-76290 | 5/1982 | Japan | 418/55 |
| 57-148092 | 9/1982 | Japan | 418/55 |

*Primary Examiner*—John J. Vrablik

*Attorney, Agent, or Firm*—Banner, Birch, McKie & Beckett

[57] ABSTRACT

A lubricating system for a scroll type compressor which includes a housing having a front end plate and a cup-shaped casing. A fluid inlet port is formed on the cup-shaped casing positioned opposite and opening onto a rotation preventing/thrust bearing device. In one embodiment, a cut portion may be formed in the fixed ring of the rotation preventing/thrust bearing device opposite the fluid inlet port. An oil passageway may then be formed in the front end plate to communicate between the cut portion and a shaft seal cavity.

10 Claims, 7 Drawing Figures

SCROLL TYPE COMPRESSOR WITH LUBRICATING SYSTEM

BACKGROUND OF THE INVENTION

This invention relates to fluid displacement apparatus, and more particularly, to a scroll type fluid compressor.

Scroll type fluid displacement apparatus are well known in the prior art. For example, U.S. Pat. No. 801,182 (Creux) discloses a scroll type fluid displacement apparatus including two scroll members each having a circular end plate and a spiroidal or involute spiral element. These scroll members are maintained angularly and radially offset so that the spiral elements interfit to make a plurality of line contacts between their spiral curved surfaces, thereby to seal off and define at least one pair of fluid pockets. The relative orbital motion of the two scroll members shifts the line contacts along the spiral curved surfaces and, therefore, the fluid pockets change in volume. The volume of the fluid pockets increases or decreases dependent on the direction of the orbital motion. Therefore, scroll type fluid displacement apparatus are applicable to compress, expand or pump fluids.

Scroll type fluid displacement apparatus are particularly well-suited for use as a refrigerant compressor in an automobile air conditioner. Generally, it is desirable that the refrigerant compressor for an automobile air conditioner be compact in size and light in weight, since the compressor is placed in the engine compartment of an automobile. However, the refrigerant compressor is generally coupled to an electromagnetic clutch for transmitting the output of an engine to the drive shaft of the compressor. The weight of the electromagnetic clutch therefore increases the total weight of a compressor unit.

In a conventional scroll-type compressor, the orbiting scroll is supported as a cantilever from its driving mechanism, which is fixed to the rear side of the orbiting scroll. Furthermore, the fluid inlet port, which is formed in the housing, is placed adjacent the peripheral portion of the spiral element of the fixed scroll to introduce fluid into the interior of the housing without a pressure loss.

However, in the above-described conventional construction of a scroll-type compressor, lubrication or cooling of the bearing portions of the supporting construction or driving mechanism for the oribiting scroll may not be sufficient. Damage to the bearing portions may result.

One solution to this problem is shown in FIG. 1 and is described generally in pending U.S. application Ser. No. 521,256, filed Aug. 8, 1983. In this construction, a fluid inlet port 2 is formed in housing 1 and located at an outer peripheral portion of a spiral element 3*a* of orbiting scroll 3. A step portion 2*a* is formed in fluid inlet port 2. Step portion 2*a* projects radially inwardly from an inner wall of fluid inlet port 2. Housing 1 is formed with a first oil passageway 4, one end of which opens at the inner wall of fluid inlet port 2. A second oil passageway 5 extends from passageway 4 to a shaft seal cavity 6, in which is positioned a shaft seal assembly 7. In operation, refrigerant gas is introduced into the interior of the housing 1 through inlet port 2. The oil mist suction gas strikes against step portion 2*a*. The oil included in the suction gas is separated therefrom and accumulates on step portion 2*a*. Following the flow of suction gas, the accumulated oil flows into first oil passageway 4, and then flows out to the shaft seal cavity 6 through second oil passageway 5. The oil which flows into the shaft seal cavity lubricates and cools the shaft seal assembly 7 and returns to the interior of housing 1 while lubricating the other bearing portions.

In this mechanism, step portion 2*a* for separating and accumulating the oil must be formed in the fluid inlet port 2. Also, the oil connected between shaft seal cavity 6 and fluid inlet port 2 must be formed in the compressor housing, requiring increased wall thickness of the housing, and thus a more complex, larger, and heavier housing construction.

SUMMARY OF THE INVENTION

It is a primary object of this invention to provide an improved scroll type compressor which is compact in size and light in weight.

It is another object of this invention to provide a scroll type compressor which is simple in construction and configuration, and easy to assemble.

It is still another object of this invention to provide a scroll type compressor wherein moving parts, in particular a shaft seal portion, are efficiently lubricated and cooled.

It is a further object of this invention to provide a scroll type compressor which has an oil circulation channel for returning the lubricant oil from a discharge chamber to a suction chamber.

A scroll type compressor according to this invention includes a housing having a front end plate and a cup-shaped casing. A fixed scroll is fixedly disposed relative to the cup-shaped casing and has a first circular end plate from which a first spiral wrap extends into an inner chamber of the cup-shaped casing. An orbiting scroll has a second circular end plate from which a second spiral wrap extends. The first and second wraps interfit at an angular and radial offset to make a plurality of line contacts to define at least one pair of sealed off fluid pockets. A driving mechanism is operatively connected with the orbiting scroll to effect the orbital motion of the orbiting scroll while preventing the rotation of the orbiting scroll by a rotation preventing mechanism, thus causing the fluid pockets to change volume due to the orbital motion of the orbiting scroll. The rotation preventing mechanism is placed between an inner side surface of a front end plate of the housing and an end surface of the second circular end plate. A fluid inlet port is formed in the cup-shaped casing, opposite and opening directly onto the rotation preventing mechanism.

The rotation preventing mechanism comprises a fixed ring fastened against the inner surface of the housing's front end plate, an orbiting ring fastened against the end surface of the second circular end plate and a plurality of balls each of which is retained a pair of facing holes or pockets formed in the fixed and orbiting rings. In one embodiment, a cut portion may be formed in the fixed ring opposite the fluid inlet port. An oil passageway may then be formed in the front end plate to communicate between the cut portion and a shaft seal cavity. Thus, the bearing portions of the compressor are effectively and efficiently lubricated and cooled.

Further objects, features and other aspects of this invention will be understood from the following detailed description of the preferred embodiments of this invention referring to the annexed drawings.

DETAILED DESCRIPTION OF THE PREFERRED EMBODIMENT

Figure 2:
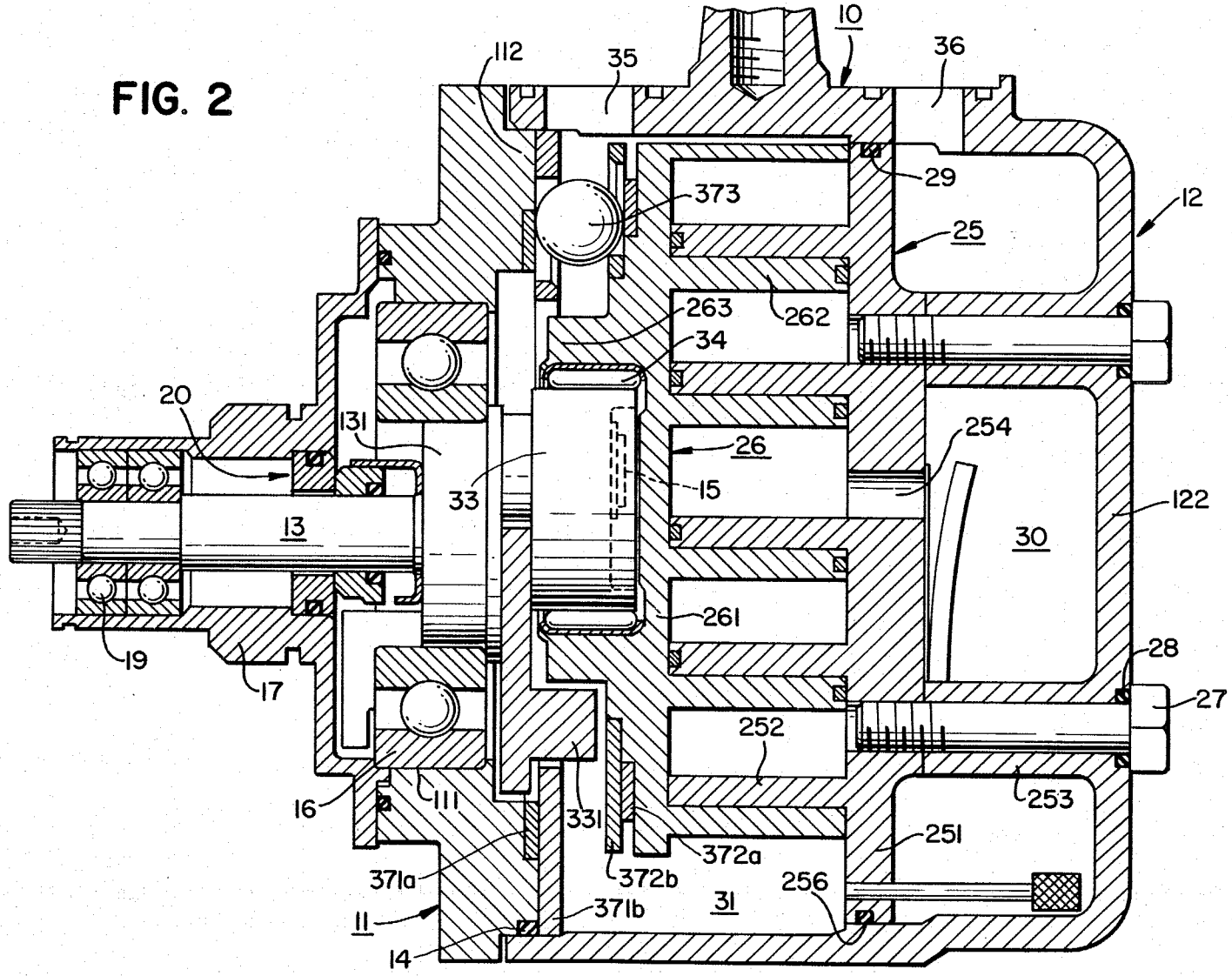
FIG. 2 is a vertical sectional view of a compressor according to one embodiment of this invention.

Referring to FIG. 2, a refrigerant compressor unit in accordance with the present invention is shown. The unit includes a compressor housing 10 comprising a front end plate 11 and a cup-shaped casing 12 which is attached to one side surface of front end plate 11. An opening 111 is formed in the center of front end plate 11 for penetration or passage of a drive shaft 13. An annular projection 112 concentric with opening 111 is formed on the inside face of front end plate 11 and projects towards cup-shaped casing 12. An outer peripheral surface of projection 112 contacts an inner wall surface of casing 12. Cup-shaped casing 12 is fixed to front end plate 11 by a fastening means, for example, a bolt and nut, not shown. The open portion of cup-shaped casing 12 is thereby covered and closed by front end plate 11.

An O-ring member 14 is placed between front end plate 11 and the opening portion of cup-shaped casing 12, to thereby secure a seal between the fitting or mating surfaces of the front end plate 11 and cup-shaped casing 12.

Figure 1:
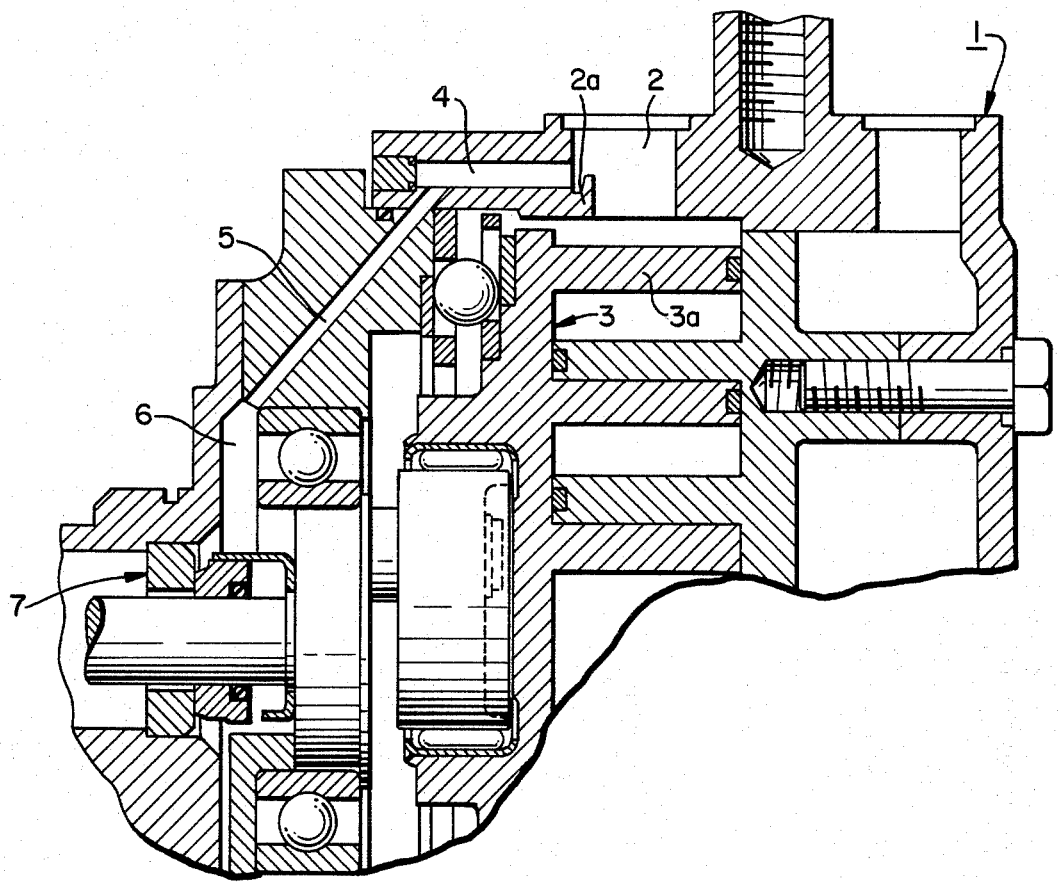
FIG. 1 PRIOR ART
FIG. 1 is a vertical sectional view of a compressor unit illustrating a known lubricating mechanism.

Front end plate 11 has an annular sleeve portion 17 projecting outwardly from the front or outside surface thereof. Sleeve 17 surrounds drive shaft 13 and defines a shaft seal cavity in which is positioned a shaft seal assembly, shown generally at 20. In the embodiment shown in FIG. 1, sleeve portion 17 is formed separately from front end plate 11 and is fixed to front end plate 11 by fastening means, such as screws (not shown). Alternatively, the sleeve portion 17 may be formed integral with front end plate 11.

Drive shaft 13 is rotatably supported by sleeve portion 17 through a bearing 19 disposed within the front end portion of sleeve portion 17. Drive shaft 13 is formed with a disk rotor 131 at its inner end portion, which is rotatably supported by front end plate 11 through a bearing 16 disposed within opening 111 of front end plate 11. A shaft seal assembly 20 is fixed on drive shaft 13 within the shaft seal cavity of front end plate 11.

Drive shaft 13 is coupled to an electromagnetic clutch, not shown, which may be disposed on the outer peripheral portion of sleeve portion 17. Thus, drive shaft 13 is driven by an external drive power source, for example, a motor of a vehicle, through a rotation force transmitting means such as an electromagnetic clutch.

A fixed scroll 25, an orbiting scroll 26, a driving mechanism for orbiting scroll 26 and a rotation preventing/thrust bearing means 37 for orbiting scroll 26 are disposed in the inner chamber of cup-shaped casing 12. The inner chamber is formed between the inner wall of cup-shaped casing 12 and front end plate 11.

Fixed scroll 25 includes a circular end plate 251 and a wrap of spiral element 252 affixed to or extending from one major side surface of circular plate 251. A bottom plate 122 of cup-shaped casing 12 is formed with a plurality of legs 253 axially projecting from its inner end surface, as shown in FIG. 2.

An axial end surface of each leg 253 is fitted against the other major side surface of circular end plate 251. Fixed scroll 25 is fixed by a plurality of screws 27 each of which screws into circular end plate 251 from the outside of bottom plate portion 122 through leg 253. A first sealing member 28 is disposed between the end surface of each leg 253 and the inner surface of bottom plate portion 122, to thereby prevent fluid leakage along screws 27. A groove 256 is formed on the outer peripheral surface of circular plate 251 and a second seal ring member 29 is disposed therein to form a seal between the inner surface of cup-shaped portion 12 and the outer peripheral surface of circular plate 251. Thus, the inner chamber of cup-shaped portion 12 is partitioned into two chambers by circular plate 251; a rear or discharge chamber 30, in which legs 253 are disposed, and a front or suction chamber 31, in which spiral element 251 of fixed scroll 25 is disposed.

Cup-shaped casing 12 is provided with a fluid inlet port 35 and a fluid outlet port 36, which respectively are connected to the front and rear chambers 31, 30. A hole or discharge port 254 is formed through the circular plate 251 at a position near to the center of spiral element 252. Discharge port 254 connects the fluid pocket formed in the center of the interfitting spiral elements and rear chamber 30.

Orbiting scroll 26 is disposed in front chamber 31. Orbiting scroll member 26 also comprises a circular end plate 261 and a wrap of spiral element 262 affixed to or extending from one side surface of circular end plate 261. Spiral element 262 and spiral element 252 interfit at an angular offset of 180° and a predetermined radial offset. A pair of fluid pockets are thereby defined between spiral elements 252, 262. Orbiting scroll 26 is connected to the drive mechanism and to the rotation preventing/thrust bearing mechanism. These last two mechanisms effect orbital motion of the orbiting scroll member 26 by rotation of drive shaft 13, to thereby compress fluid passing through the compressor unit.

Figure 3:
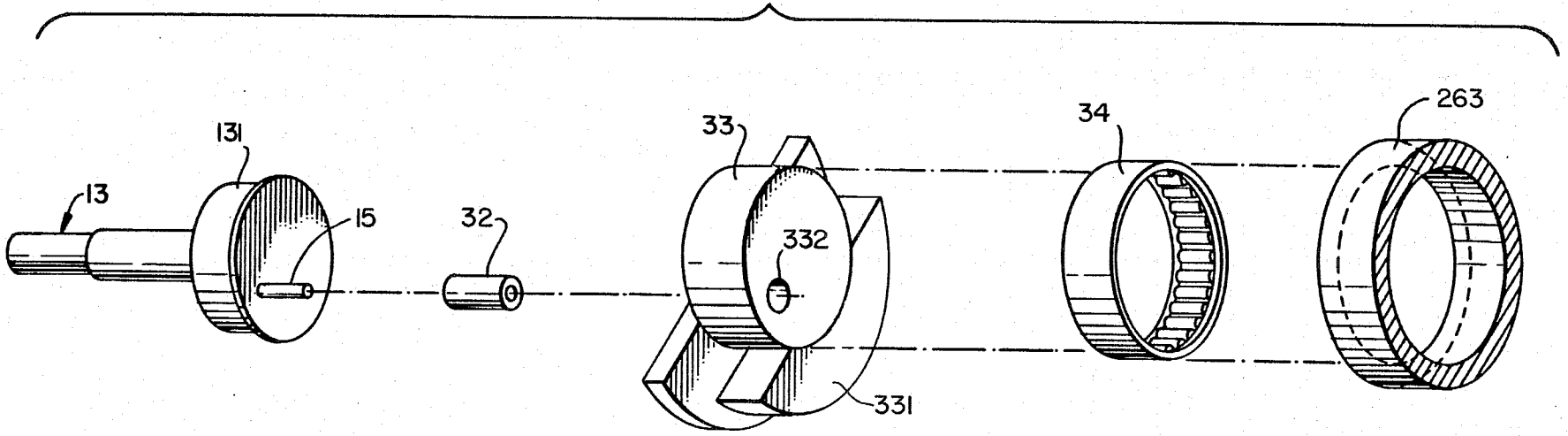
FIG. 3 is an exploded perspective view of a driving mechanism in the embodiment of FIG. 2.

Referring to FIGS. 2 and 3, the driving mechanism of orbiting scroll 26 will be described. Drive shaft 13, which is rotatably supported by sleeve portion 17 through ball bearing 19, is formed with a disk rotor 131. Disk rotor 131 is rotatably supported by front end plate 11 through ball bearing 16 disposed within opening 111 of front end plate 11.

Figure 4:
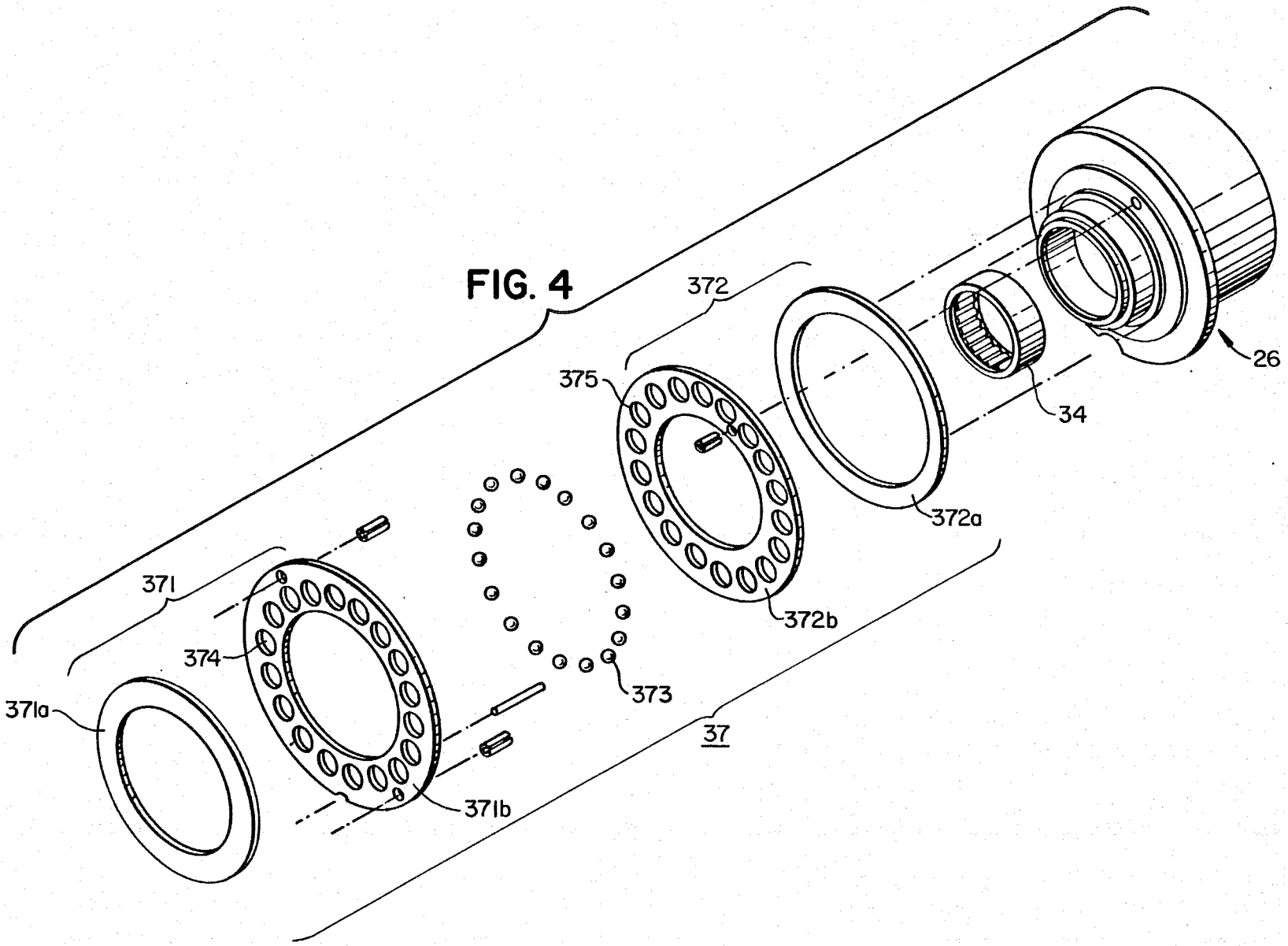
FIG. 4 is an exploded perspective view of a rotation preventing/thrust bearing mechanism in the embodiment of FIG. 2.

A crank pin or drive pin 15 projects axially inwardly from an end surface of disk rotor 131 and is radially offset from the center of drive shaft 13. Circular plate 261 of orbiting scroll 26 is provided with a tubular boss 263 projecting axially outwardly from the end surface opposite to the side from which spiral element 262 extends. A discoid or short axial bushing 33 is fitted into boss 263, and is rotatably supported therein by a bearing, such as a needle bearing 34. Bushing 33 has a balance weight 331 which is shaped as a portion of a disk or ring and extends radially from bushing 33 along a front surface thereof. An eccentric hole 332, as shown in FIG. 3, is formed in bushing 33 radially offest from the center of bushing 33. Drive pin 15 is fitted into the eccentrically disposed hole 332, within which a bearing 32 may be inserted. Bushing 33 is therefore driven by the revolution of drive pin 15 and permitted to rotate by needle bearing 34. The spiral element of orbiting scroll 26 is thus pushed against the spiral element of fixed scroll 25 due to the moment created between the driving point and the reaction force acting point of the pressurized gas. Referring to FIG. 2 and FIG. 4, a rotation preventing/thrust bearing device 37 is placed between the inner end surface of front end plate 11 and the end surface of circular end plate 261 of orbiting scroll 26 wich faces the inner end surface of front end plate 11.

Rotation preventing/thrust bearing device 37 includes a fixed ring 371, which is fastened against the inner end surface of front end plate 11, an orbiting ring 372, which is fastened against the end surface of circular end plate 261, and bearing elements, such as a plurality of spherical balls 373. Both rings 371 and 372 have a plurality of pairs of facing circular indentations or holes 374 and 375 and one ball 373 is retained in each of these pairs of holes 374 and 375. As shown in FIG. 4, both rings 371 and 372 are formed by separate plate elements 371*a* and 372*a*, and retainer elements 371*b* and 372*b*, in which the plurality of pairs of holes 374 and 375 are formed. The elements of each ring are respectively fixed by suitable fastening means. Alternatively, the plate and ring elements may be formed integral with one another.

In operation, the rotation of orbiting scroll 26 is prevented by balls 373, which interact with the edges of holes 374 and 375 to prevent rotation. Also, balls 373 carry the axial thrust load from orbiting scroll 26. Thus, orbiting scroll 26 orbits while maintaining its angular orientation with respect to fixed scroll 25.

In this invention, as shown in FIG. 2, cup-shaped casing 12 is provided with a fluid inlet port 35, which is placed on casing 12 opposite and opening directly onto the rotation preventing/thrust bearing device 37. Therefore, the refrigerant gas which is introduced into suction chamber 31 through fluid inlet port 35 strikes against rotation preventing/thrust bearing device 37, which serves to separate the lubricating oil from the suction gas. After separation, the lubricating oil adheres to the balls and surfaces of orbiting and fixed rings 371 and 372 and the rolling surface of the balls 373, thus lubricating the rolling surface. The suction gas also cools and lubricates the other parts and bearing portions disposed within cup-shaped casing 12.

Figure 5:
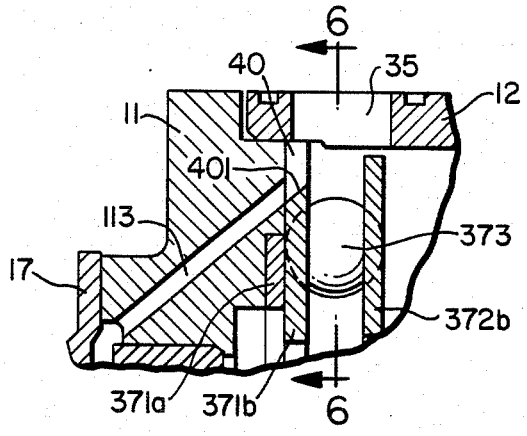
FIG. 5 is an enlarged sectional view of a compressor illustrating a lubricating mechanism according to one embodiment of this invention.
Figure 6:
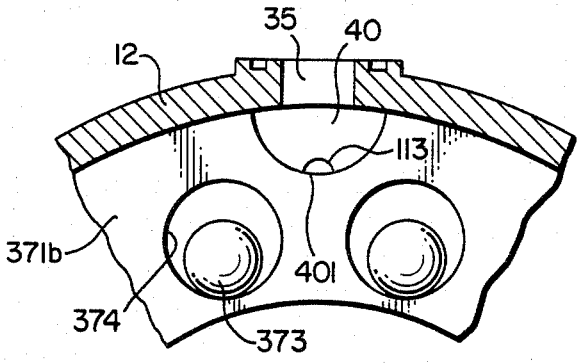
FIG. 6 is a sectional view taken along line 6—6 in FIG. 5.

FIGS. 5 and 6 show another embodiment of the compressor according to this invention in which the lubricating mechanism for shaft seal assembly 20 is modified from that previously described. In this embodiment, a lubricating oil passageway 113 is formed in front end plate 11 between the shaft seal cavity of front end plate 11 and suction chamber 31. The outer peripheral portion of fixed ring 371, which faces the fluid inlet port 35, is provided with a cut portion 40. One end of oil passageway 113 opens to the inner surface of front end plate 11 adjacent to cut portion 40 of fixed ring 371. As shown in FIG. 6, a part of oil passageway 113 is covered by fixed ring 371.

Figure 7:
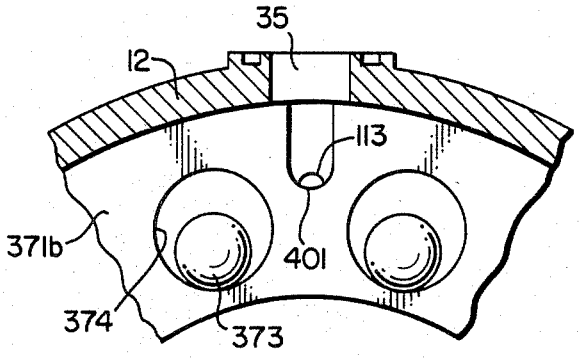
FIG. 7 is a sectional view of a compressor illustrating a lubricating mechanism according to another embodiment of this invention.

In operation, the refrigerant gas which is introduced into suction chamber 31 through fluid inlet port 35 strikes the bottom surface 401 of cut portion 40. The lubricating oil is separated from the suction refrigerant gas and accumulates on bottom surface 401. Following the flow of suction gas, the accumulated oil flows into oil passageway 113, and then flows out to the shaft seal cavity of front end plate 11. The oil which flows into the shaft seal cavity lubricates and cools the shaft seal assembly 20 and returns to suction chamber 31 through bearing 16 while lubricating bearing 16. In the embodiment shown in FIGS. 5 and 6, cut portion 40 is formed as an arc-shaped configuration, as shown clearly in FIG. 6. Alternatively, cut portion 40 may be formed as a U-shaped configuration, as shown in FIG. 7. Other shapes for cut portion will be obvious to those of ordinary skill. Additionally, bottom surface 401 of cut portion 40 may be a flat surface, i.e., perpendicular to the end surface of fixed ring 371 as shown in dotted line in FIG. 5, or, alternatively, the bottom surface may be inclined or angled with respect to the end surface of fixed ring 371, as shown in FIG. 5.

The invention has been described in detail in connection with a preferred embodiment, but these are examples only and this invention is not restricted thereto. It will be easily understood by those skilled in the art that the other variations and modifications can be easily made within the scope of this invention, which is defined only by the following claims.

I claim:

1. In a scroll type compressor including a housing comprising a front end plate and a cup-shaped casing, a fixed scroll fixedly disposed within said housing and having a first circular end plate from which a first wrap extends, an orbiting scroll having a second circular end plate from which a second wrap extends, said first and second wraps interfitting at an angular and radial offset to make a plurality of line contacts to define at least one pair of sealed off fluid pockets, a driving mechanism operatively connected with said orbiting scroll to effect the orbital motion of said orbiting scroll, a rotation preventing/thrust bearing device for preventing the rotation of said orbiting scroll while allowing orbital motion, and thus changing the volume of said fluid pockets due to the orbital motion of said orbiting scroll, the improvement comprising:

said first circular end plate dividing the interior of said housing into a suction chamber and a discharge chamber;

said rotation preventing/thrust bearing device positioned in said suction chamber between an inner end surface of said front end plate and an end surface of said second circular end plate of said orbiting scroll; and a fluid inlet port in said cup-shaped casing for introducing a mixture of gas and lubricant into said suction chamber, said fluid inlet port positioned opposite and opening onto said rotation preventing/thrust bearing device so that the mixture of gas and lubricant introduced into said suction chamber through said inlet port strikes against said rotation preventing/thrust bearing device, said rotation preventing/thrust bearing device separating the lubricant from the gas.

2. The scroll type compressor of claim 1 wherein said rotation preventing/thrust bearing device includes a fixed ring fastened against the inner end surface of said front end plate, an orbiting ring fastened against the end surface of said second circular end plate and ball elements each of which is retained in a pair of facing pockets formed in said rings, and wherein the outer peripheral portion of said fixed ring has a cut portion which faces said fluid inlet port.

3. The scroll type compressor of claim 2 further comprising a lubricant passageway formed through said front end plate connecting the interior of said casing and a shaft seal cavity formed in said front end plate.

4. The scroll compressor of claim 3 wherein one end of said lubricant passageway opens to the inner wall of said front end plate adjacent to said cut portion of fixed ring.

5. The scroll type compressor of claim 2 wherein a bottom surface of said cut portion is flat.

6. The scroll type compressor of claim 2 wherein a bottom surface of said cut portion is inclined.

7. A scroll type compressor comprising:

a housing having a front end plate and a cup-shaped casing;

a fixed scroll fixedly disposed within said housing and having a first circular end plate from which a first wrap extends, said first circular end plate dividing said housing into a suction chamber and a discharge chamber;

an orbiting scroll having a second circular end plate from which a second wrap extends, said first and second wraps interfitting at an angular and radial offset to make a plurality of line contacts to define at least one pair of sealed off fluid pockets;

a driving mechanism operatively connected to said orbiting scroll to effect the orbital motion of said orbiting scroll;

a rotation preventing/thrust bearing device positioned in said suction chamber between an inner end surface of said front end plate and an end surface of said second circular end plate to prevent the rotation of said orbiting scroll while allowing orbital motion of said orbiting scroll; and a fluid inlet port in said cup-shaped casing for introducing a fluid comprising a mixture of a gas and a lubricant into said suction chamber, said fluid inlet port positioned opposite and opening onto said rotation preventing/thrust bearing device so that the mixture of gas and lubricant introduced into said suction chamber through said inlet port strikes against said rotation preventing/thrust bearing device, said rotation preventing/thrust bearing device separating the lubricant from the gas.

8. A scroll type compressor comprising:

a housing having a front end plate and a cup-shaped casing;

a fixed scroll fixedly disposed within said housing and having a first circular end plate from which a first wrap extends, said first circular end plate dividing said housing into a suction chamber and a discharge chamber;

an orbiting scroll having a second circular end plate from which a second wrap extends, said first and second wraps interfitting at an angular and radial offset to make a plurality of line contacts to define at least one pair of sealed off fluid pockets;

a driving mechanism operatively connected to said orbiting scroll to effect the orbital motion of said orbiting scroll;

a rotation preventing/thrust bearing device positioned in said suction chamber between an inner end surface of said front end plate and an end surface of said second circular end plate to prevent the rotation of said orbiting scroll while allowing orbital motion of said orbiting scroll, said device comprising a fixed ring fastened against the inner end surface of said front end plate, an orbiting ring fastened against the end surface of said second circular end plate and a plurality of ball elements each of which is retained in a pair of facing pockets formed in said rings;

a fluid inlet port formed in said cup-shaped casing for introducing a fluid comprising a mixture of a gas and a lubricant into said suction chamber, said fluid inlet port positioned opposite and opening onto said rotation preventing/thrust bearing devices so that the mixture of gas and lubricant introduced into said suction chamber through said inlet port strikes against said rotation preventing/thrust bearing device, said rotation preventing/thrust bearing device separating the lubricant from the gas;

a cut portion formed opposite said fluid inlet port in a part of said fixed of rotation preventing/thrust bearing device; and a lubricant passageway formed in said front end plate to communicate between an interior of said cup-shaped casing and a shaft seal cavity in said front end plate wherein one end of said passageway opens adjacent to said cut portion of fixed ring.

9. The scroll type compressor of claim 8 wherein a bottom surface of said cut portion is flat.

10. The scroll type compressor of claim 8 wherein a bottom surface of said cut portion is inclined.

* * * * *